United States Patent [19]

Shamie

[11] Patent Number: 4,639,956

[45] Date of Patent: Feb. 3, 1987

[54] MATTRESS SUPPORT FOR CRIB

[76] Inventor: Louis Shamie, 630 Avenue V, Brooklyn, N.Y. 11225

[21] Appl. No.: 673,476

[22] Filed: Nov. 20, 1984

[51] Int. Cl.[4] ..... A47D 7/00; A47C 19/00

[52] U.S. Cl. ..... 5/93 R; 5/200 R; 5/200 C; 5/201; 5/299; 5/400

[58] Field of Search ..... 5/11, 93 R, 200 R, 200 C, 5/207, 208, 186 B, 201, 299, 203, 400

[56] References Cited

U.S. PATENT DOCUMENTS

| | | | |
|---|---|---|---|
| 406,438 | 7/1889 | Franz | 5/238 |
| 614,820 | 11/1890 | Anderson | 5/238 |
| 633,651 | 9/1899 | Kohn | 5/299 |
| 919,865 | 4/1909 | Holden | 5/11 |
| 1,389,697 | 9/1921 | Phipps | 5/299 |
| 2,223,955 | 12/1940 | Greenbaum | 5/93 R |
| 3,354,475 | 11/1967 | Martin | 5/93 R |
| 3,634,894 | 1/1972 | Harbison | 5/93 R |
| 4,214,325 | 7/1980 | Camacho | 5/11 |

*Primary Examiner*—Gary L. Smith
*Assistant Examiner*—Michael F. Trettel
*Attorney, Agent, or Firm*—McGlew and Tuttle

[57] ABSTRACT

A mattress support for a crib having a frame defining a space comprises four vertical brackets connected to four posts of the crib frame. Each bracket has a plurality of vertically spaced open ended slots with open mouths of each slot facing toward a centerline of the crib. A pair of beams which each have pins extending from their end are engaged with the vertical brackets so that at least one pin at one end of each beam is engaged in one slot of each bracket. A cross member engages the beams to hold them apart and hold their pins in the appropriate slot.

6 Claims, 7 Drawing Figures

MATTRESS SUPPORT FOR CRIB

FIELD AND BACKGROUND OF THE INVENTION

The present invention relates in general to infant cribs and in particular to a new and useful mattress support for such cribs.

Cribs for growing infants generally include an adjustable mattress support which can position a mattress at a variety of vertical locations within the crib frame. Known mattress supports utilize four vertical brackets which have hooks or openings at spaced vertical locations which are meant to engage generally L-shaped bails. The bails are connected to a spring or other mattress carrying member. A suitable mattress is provided over the carrying member. U.S. Pat. No. 3,896,514 to Feldstein shows vertical mattress supports which include openings for receiving L-shaped bails which are meant to support a mattress.

The use of L-shaped bails or similar members requires that, when adjusting the height of a mattress, each bail must be moved separately from one location to another on the four vertical brackets. Another problem is that the bails are not positively connected to the vertical brackets in that they simply rest on hooks or in openings of the brackets. A dangerous condition thus exists. A normally active child for example, by jumping in the crib, may cause the mattress carrying support to jump, thus dislodging one or more of the bails from the vertical brackets.

SUMMARY OF THE INVENTION

The present invention is drawn to an arrangement for supporting a mattress in a bed, and in particular in an infants crib, which is more secure than known mattress supports while at the same time being easier to adjust.

Accordingly an object of the present invention is to provide a mattress support for a crib having a frame which defines a space, the support comprising at least two and preferably four vertical members connected to the frame on opposing sides of the space, each vertical member having a plurality of vertically spaced open ended slots with each slot having an open mouth and a blind space, a mattress support member engaged with each vertical member, the mattress support having at least one pin insertable into one of the open mouths and seated in one of the blind spaces, and cross member engaged between the supports for holding them apart.

A further object of the invention is to form the open ended slots to have open mouths which face each other on opposites sides of a centerline of the crib so that the cross members in holding the support members apart also hold the pins in the blind spaces of the slots. In this way even violent movements of a child in the crib will not dislodge the support members from the vertical members.

A still further object of the invention is to provide a mattress support which is simple in design rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
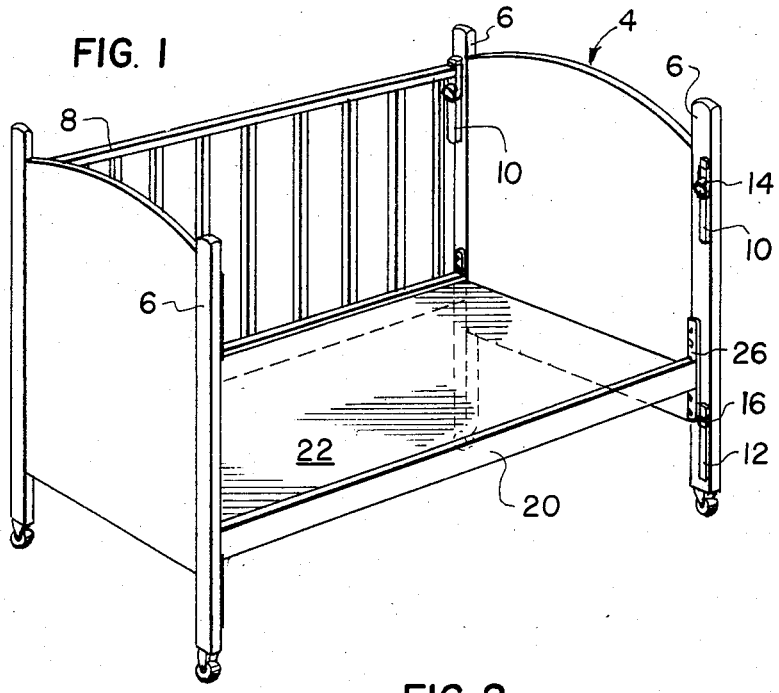
FIG. 1 is a perspective view of a crib with one drop side missing and showing the inventive mattress support.

Referring to FIG. 1, the invention embodied therein comprises a support arrangement for the mattress of a crib generally designated 4 which comprises a frame made up of vertical posts 6. The frame defines an interior space which is bounded by the ends of the frame which are connected to the posts 6, as well as drop sides 8 (only one of which is shown). The drop sides are connected to upper and lower slides 14, 16 which slide vertically on guide members 10,12 connected to the posts or frame members 6. A safety arrangement for operating the drop sides 8 is disclosed in a co-pending application to the same inventor entitled DOUBLE ACTION CRIB DROP SIDE LOCK, Ser. No. 468,359, filed Feb. 22, 1983 now U.S. Pat. No. 4,530,528.

According to the present invention, a pair of support members or beams 20 span pairs of the vertical posts 6 and are connected to these posts at vertical members or brackets 26. Four brackets 26 are connected to the four posts 6. A cross member or plate 22 engages the beams 20 and is provided to support a mattress shown at 24 in FIG. 2.

Figure 2:
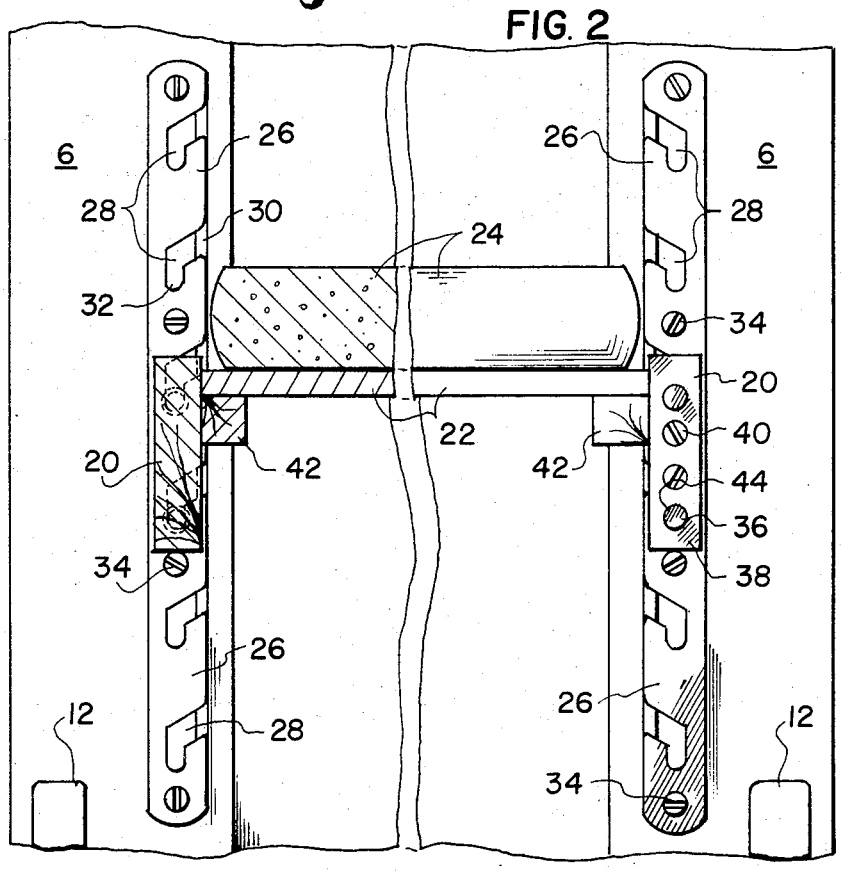
FIG. 2 is a side elevational view, partially in section, of an interior end wall of the crib in FIG. 1 showing additional details of the inventive mattress support.

As shown in FIG. 2, two of the beams 20,20 are on opposite sides of the space defined by frame posts 6. Each beam has a shoulder or stop member 42 which supports the cross member 22.

Figure 3:
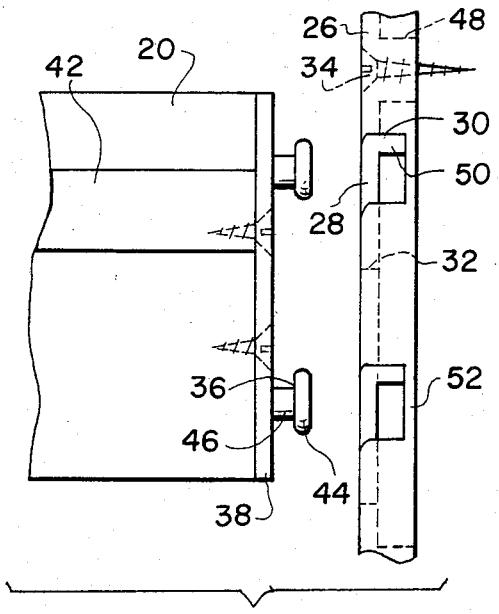
FIG. 3 is an exploded partial elevational view of a mattress support beam and a vertical support member which are engaged together to support a mattress.
Figure 4:
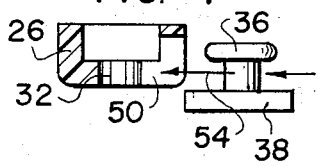
FIG. 4 is a top sectional view showing the direction of movement for a part of the mattress beam for engaging its pins with a vertical bracket forming the vertical member.
Figure 5:
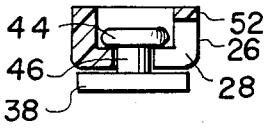
FIG. 5 is a view similar to FIG. 4 showing the pin of the beam engaged with the bracket.

Each vertical member 26 includes a plurality of vertically spaced open ended slots 28. Each slot 28 has an open mouth 30 which is also shown in FIGS. 3, 4 and 5. Each slot 28 also has a blind base 32 which is positioned below the mouth 30 of each slot.

Each beam 20 has a pin plate 38 connected to each end thereof as shown in FIGS. 2 through 5. Two pins 36 extend outwardly from each plate 38. Each pin 36 has a head 44 and a smaller diameter stem 46 which connects the head to the plate 38. The spacing between pins 36 on each plate are equal to the spacing between adjacent slots 28 on each vertical member or bracket 26.

As apparent from FIG. 2, the open mouths 30 of one bracket face inwardly of the space defined by the crib frame, and actually face toward the open mouths of the slots on an opposing bracket 26. With the cross member of plate 22 in place between beams 20 and on shoulders 42, the beams 20 are held apart. The weight of the mattress holds the beams down so that it is virtually impossible to accidently dislodge the beams 20 from the brackets 26, even if an infant jumps up and down on the mattress 24. The worst that might happen is that the mattress plus its cross member 22 will bounce up but even this will not dislodge the pins 36 of the brackets 20 from their slots 28.

To initially engage the beams onto their respective vertical brackets, or to adjust the vertical position of the mattress, a beam 20 on one side of the crib is first positioned in the space defined by the frame posts 6 and then, with its pins 36 aligned with the mouths 30 of appropriate brackets 26, the beams are moved outwardly to engagement with the open mouths 30. As shown in FIG. 4, this moves beam plates 38 with their pins 36 in the direction of arrow 54. The mouth 30 of each beam has a vertical height which is at least as large as the diameter of the head 44 of each pin 36 so that the pin can easily enter the mouth. Each slot defines an inclined ramp 50 which produces a natural outward and downward movement of each beam. This continues until the head 44 is seated within the space defined by each bracket 26 (see FIG. 5) with stem 64 of each pin being seated in each blind base 32.

As shown in FIG. 2, the vertical brackets or members 26 are connected to posts 6 by screws 34. Plates 38 can be connected to the ends of the beams 20 by screws 40.

As shown in FIG. 2, screws 34 extend through thick web portions 38 of the brackets 26 which can be formed of high impact plastic or other suitable material. The open mouth 30 of each slot 28 is also doubled and curved to facilitate the easy entry of the pins 36.

While it is preferred that two pins be provided at each end of each beam, a single pin may also operate as long as the beam is otherwise held from rotation, for example by the shape and engagement of the cross member 22.

Although the cross member is shown as a plate in FIG. 2 for supporting mattress 24, two separate cross members might be provided at opposite ends of the beams for holding them apart. The support beam 20 also can be replaced by shorter support members which do not necessarily span the entire length of the crib but rather form a step or other engagement surface for supporting the cross member 22.

The cross member 22 can also be replaced by a box spring or spring frame of known design (not shown).

Figure 6:
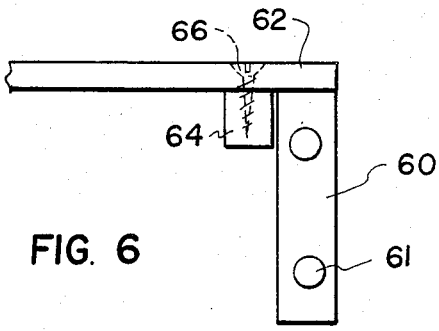
FIG. 6 is a partial elevational view of another embodiment of the invention.

FIG. 6 shows an alternate embodiment of the invention wherein the stop mechanism between a cross member 62 and a support beam 60 is in the form of a shoulder member 64 connected to the cross member 62 by screws 66. Pins 61 are shown on beam 60.

Figure 7:
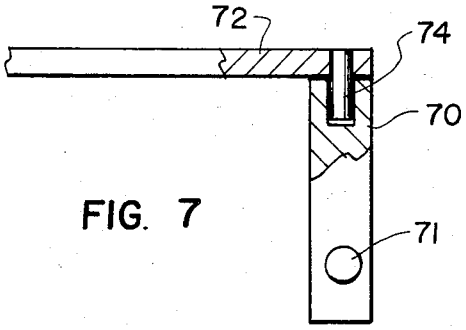
FIG. 7 is a view similar to FIG. 6 with portions cut away and showing another embodiment of the invention.

FIG. 7 shows a still further embodiment of the invention wherein the stop mechanism comprises a pin 64 connected to a cross member 72 and seated in an opening at the top of a beam 70 which also carries one or more pins 71.

While specific embodiments of the invention have been shown and described in detail to illustrate the application of the principles of the invention, it will be understood that the invention may be embodied otherwise without departing from such principles.

What is claimed is:

1. A mattress support for a crib having a frame with inner surfaces which define a space, said frame having one end and an opposite end and one side and an opposite side, the mattress support comprising:

a first pair of spaced apart vertical posts at the one end of the frame, each having an inner surface facing the opposite end of the frame;

a second pair of spaced apart vertical posts at the opposite end of the frame, each having an inner surface facing the one end of the frame;

a vertical bracket connected to each of said vertical posts, each vertical bracket being connected on said inner surface of its vertical post, each vertical bracket having a plurality of vertically spaced slots, each slot having an open mouth and a blind base positioned vertically below the open mouth, the open mouths of slots of each bracket at the one end of the frame facing each other and the open mouths of slots of each bracket at the opposite end of the frame facing each other, the blind bases of slots at each end of the frame being spaced from each other by a greater amount than the open mouths of slots at each end of the frame;

a pair of mattress support beams extending between said first and second pair of vertical posts, one of said mattress support beams being positioned on the one side of the frame and the other of said mattress support beams being positioned on the opposite side of the frame, each mattress support beam having a pair of fixed pins extending from each end thereof, each pair of fixed pins being insertable into a pair of said open mouths and being seated in a pair of said blind bases of a different vertical bracket, pins at a one end of each beam being seated in blind bases of vertical brackets of said first pair of vertical posts and pins at an opposite end of each beam being seated in blind bases of vertical brackets of said second pair of vertical posts;

a cross member engaged between and on said pair of mattress support beams for holding each pin seated in its blind base, said cross member acting as stop means for holding said mattress support beams apart, said cross member extending substantially the full length of said mattress support beams from the one end of the frame to the opposite end of the frame and substantially spanning the distance between said support beams from one side of the frame to the opposite side of the frame.

2. A mattress support according to claim 1, including a shoulder connected to a side of each beam facing the space for supporting said cross member.

3. A mattress support according to claim 2, wherein said cross member comprises a mattress support plate.

4. A mattress support according to claim 1, including a shoulder connected to said cross member and engaged against an inside of each support beam with respect to the frame space.

5. A mattress support according to claim 1, including a stop post extending from said cross member and a bore for receiving said post defined in said support beam.

6. A mattress support according to claim 1, wherein each pin has a large diameter head and a small diameter stem, each open mouth having a vertical size at least equal to a diameter of said large diameter head and each blind base having a diameter smaller than that of said large diameter head and at least equal to a diameter of said stem so that each stem is seated in a blind base of one of said slots.

* * * * *